US006525459B1

(12) United States Patent
Ogura

(10) Patent No.: US 6,525,459 B1
(45) Date of Patent: Feb. 25, 2003

(54) CRT BEAM LANDING SPOT SIZE CORRECTION APPARATUS AND METHOD

(75) Inventor: Toshiyuki Ogura, San Diego, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/418,671

(22) Filed: Oct. 14, 1999

Related U.S. Application Data

(60) Provisional application No. 60/104,253, filed on Oct. 14, 1998.

(51) Int. Cl.[7] ..... H01J 29/50; H01J 29/51

(52) U.S. Cl. ..... 313/412; 313/414; 313/415; 313/442; 313/447; 315/368.15

(58) Field of Search ..... 313/414, 412, 313/413, 415, 409, 446, 447, 449, 439, 428, 442; 315/382, 15, 382.1, 368.15

(56) References Cited

U.S. PATENT DOCUMENTS 4,758,762 A * 7/1988 Van Gorkum et al. ..... 313/440
4,814,670 A 3/1989 Suzuki et al. ..... 315/15
5,142,189 A 8/1992 Sugahara et al. ..... 313/414
5,461,278 A * 10/1995 Misono et al. ..... 313/414
5,517,078 A * 5/1996 Sugawara et al. ..... 313/412
5,539,285 A * 7/1996 Iguchi et al. ..... 315/382
6,153,970 A * 11/2000 Chen et al. ..... 313/412
6,172,450 B1 * 1/2001 Natori et al. ..... 313/412
6,232,711 B1 * 5/2001 Sugiyama et al. ..... 313/414
6,236,153 B1 * 5/2001 Kim ..... 313/414

FOREIGN PATENT DOCUMENTS

JP 02072546 * 3/1990 ..... H01J/29/50

* cited by examiner

*Primary Examiner*—Ashok Patel
*Assistant Examiner*—Sikha Roy
(74) *Attorney, Agent, or Firm*—Skjerven Morrill LLP

(57) ABSTRACT

A 90 percent electron gun aperture astigmatism is used in conjunction with a four-pole electromagnet to make a CRT electron beam just focus point and minimum beam width occur closer to the same focus voltage. A single grid may have the 90 percent astigmatism, or astigmatisms in two or more grids may combine to produce an effective 90 percent astigmatism. A four-pole electromagnet is positioned around the focusing grid and current driving the electromagnet is varied with beam position during normal operation.

11 Claims, 10 Drawing Sheets

CRT BEAM LANDING SPOT SIZE CORRECTION APPARATUS AND METHOD

RELATED APPLICATION

Provisional application No. 60/104,253 was filed with the U.S. Patent and Trademark Office on Oct. 14, 1998.

BACKGROUND

1. Field of Invention

This invention relates to cathode ray tube electron guns. More particularly, the invention relates to an electron gun configuration and a method for improving the electron beam landing geometry at the extreme edges of a cathode ray tube viewing screen.

2. Related Art

Cathode ray tubes (CRTs) used in consumer electronics, e.g., television receivers, must present good picture quality. One desirable quality is uniform picture brightness and color purity over the entire viewing screen. That is, a uniformly bright white picture should result when the CRT electron gun excites all viewing screen phosphor elements to emit visible light. Another desirable quality is good focus for the displayed picture. Both qualities depend on proper landing geometry of the electron beam incident on the excited phosphor. Proper landing geometry is difficult to obtain, especially in the corners, with viewing screens that are nearly flat and that have a high width to height aspect ratio such as 16:9.

Picture uniformity requires that the beam width of the electron beam portion striking the phosphor elements be uniform over the entire phosphor area. For example, FIG. 1 is a simplified representational plan view showing a cross section of a typical SONY® TRINITRON® CRT, such as a model 36RV, and electron beams directed to excite phosphor stripes that emit colored light. As shown, composite electron beam 20 originates from three electron sources (e.g., cathodes) 22, 24, and 26. Persons skilled in the art will understand that each source 22, 24, and 26 is controlled by circuits that decode a television picture signal, each source emitting electrons so as to energize colored light emitting phosphors to create a color picture. Thus electron beam 20 may include component beam 28 that energizes phosphors emitting blue light, component beam 30 that energizes phosphors emitting green light, and component beam 32 that energizes phosphors emitting red light.

Beam 20 is directed against aperture grill 34 in which aperture slits 36 are defined. In this example, two slits 36 are shown. Portions 28*a* and 28*b* of beam 28 pass through the aperture slits 36 to illuminate, for example, blue phosphor stripes 38. Similarly, portions 30*a* and 30*b* of beam 30 illuminate, for example, green phosphor stripes 40, and portions 32*a* and 32*b* of beam 32 illuminate, for example, red phosphor stripes 42. As shown, phosphor stripes are separated by carbon stripes 44.

The cross-sectional area of beam 20 incident on phosphor screen 35 is the spot size. The cross-sectional shape of beam 20 incident on phosphor screen 35 is the spot shape. As discussed below, spot size and shape are important to achieving proper focus.

The width of the electron beam portions incident on the phosphor stripes is the beam width. Beam width is a critical factor in controlling the landing performance of an electron beam portion incident on a phosphor stripe. FIG. 2 is a simplified cross-sectional view of an electron beam portion, e.g., portion 30*a*, passing though aperture slit 36 and incident on a phosphor stripe, e.g. stripe 40. As shown, the beam width is somewhat wider than the width of aperture 36 due to scattering effects persons skilled in CRT design will understand. Persons skilled in CRT design will also understand factors that effect landing performance, such as the change in gaussian energy distribution over the beam width and the diffraction occurring as the beam passes through an aperture. For good landing performance, portion 30*a* is aligned so that the beam width uniformly overlaps carbon stripes 44 on either side of phosphor stripe 40, shown as position 46. Uniform phosphor stripe coverage ensures uniform energy distribution to excite the phosphor stripe for maximum brightness. It can be seen that if portion 30*a* is shifted to the left or right, for example to position 48, landing performance may decrease. Similarly, if beam width is too wide or too narrow, landing performance decreases because the energy of the electron beam portion is not optimally distributed over the phosphor stripe. Accordingly, there is an optimum beam width and position for an electron beam portion incident on a phosphor stripe.

To ensure picture uniformity, landing performance must be the same for every beam portion incident on every phosphor stripe over the entire viewing area. Persons skilled in CRT design will understand that without any correction, landing performance in the center of the CRT viewing area differs from performance at each of the corners due to the increased deflection of the electron beam and the increased distance from gun to screen. But in addition to landing performance, good focus must be maintained over the viewing area as well. Focus performance is primarily based on spot size and shape.

Factors such as the earth's magnetic field distort spot size and shape as the beam is scanned over the aperture grill. The most severe distortions typically occur in the corners of the viewing screen. Furthermore, since the CRT viewing area is typically rectangular, horizontal and vertical spot size and shape distortions (beam cross-sectional astigmatisms) differ at the corners due to the length of the respective deflections. Persons skilled in CRT design will be familiar with various conventional correction methods such as SONY's Auto Beam Landing Correction (BLC), Multi-Astigmatism Lens System (MALS), and Extended Field Elliptical Aperture Lens (EFEAL).

To achieve good focus, the beam cross-section is shaped to ensure proper spot size and shape over the entire viewing screen. Since the spot size and shape changes as the beam is scanned across the screen, the shaping must be dynamic so as to vary with beam position. In TRINITRON® systems, the beam is shaped using an electromagnet positioned around the main focusing grid in the electron gun, as discussed below.

FIG. 3 illustrates electron gun 49 and beam shaping and deflection components used in a typical TRINITRON® CRT. As shown, three cathodes 50*a*, 50*b*, and 50*c*, produce electrons in response to signals from conventional circuits (not shown) that decode a color television picture signal. Electrons are directed as shown through a series of grids G1, G2, G3, G4, and G5 to produce a composite electron beam that excites colored light emitting phosphors as described above. Grid G4 is the main focusing grid, and in some electron guns component beams 54*a*, 54*b*, and 54*c* converge in grid G4. Conventional focusing is performed in grid G4 using focusing elements (omitted for clarity) driven by focus voltage driver 51 that supplies focus voltage $V_F$ on lines 53 to terminal 53*a* on grid G4. Beam 54 is focused to produce good spot size as beam 54 sweeps across aperture grill 55 to illuminate phosphor coating 64 on viewing screen 66. Persons skilled in CRT design will understand the details of beam focusing.

Persons skilled in CRT design will also understand the use of a four-pole electromagnet to alter beam spot shape. (See, e.g., U.S. Pat. No. 3,946,266, assigned to the present assignee and incorporated herein by reference.) The following brief discussion illustrates basic concepts. Electromagnet 52 with four poles is positioned around grid G4. As depicted in FIG. 3, only the top two poles 52*a* and 52*b* are shown. As described herein, the electromagnet is referred to as Dynamic Quadra-Pole (DQP) magnet. FIG. 4 is a representational side view of DQP magnet 52 with poles 52*a*, 52*b*, 52*c*, and 52*d* positioned around grid G4 (omitted for clarity). As shown, electron beam 54 travels out of the paper towards the viewer. DQP driver 56 is connected to DQP magnet 52 using lines 58. DQP driver 56 controls the magnetic fields among poles 52*a*–52*d*, represented by field lines 60, by supplying DQP current $i_{DQP}$ along lines 58. Thus current $i_{DQP}$ varies as a function of beam position. Persons skilled in CRT design will understand that the spot size and shape of beam 54 may be shaped by varying $i_{DQP}$ to move the magnetic fields through which beam 54 travels. In practice the required $i_{DQP}$ is first simulated, and then fine tuned for an actual sample. The DQP is effective for TRINITRON® CRTs because of the single beam convergence point in grid G4.

Referring again to FIG. 3, spot size and shape are also influenced by directing each of the three component electron beams 54*a*, 54*b*, and 54*c* through three corresponding shaped apertures in each of grids G1 and G5. Thus grid G1 has three unique apertures, one for each component electron beam 54*a*, 54*b*, and 54*c*. After these component beams converge in grid G4, composite beam 54 is directed through a single aperture in grid G5. The apertures have a small deviation (or "astigmatism") from circular. Current CRTs have apertures in which the height:width (vertical:horizontal) aspect ratio is approximately 98:100 (98 percent astigmatism). This 98 percent astigmatism, combined with the changing DQP magnetic fields and the focus voltage, helps to correct the spot size and shape so as to improve landing performance at the edges of phosphor coating 64 at viewing screen 66 in CRT envelope 68 (partially omitted for clarity). Prior to the present invention, CRT engineers believed that an aperture astigmatism and DQP magnetism are fully supplementary. Therefore 98 percent was selected to reduce DQP circuit power consumption.

Beam deflection for scanning is typically carried out by conventional deflector electromagnets (deflection yoke), represented by electromagnets 70 and 72. Persons skilled in CRT design are familiar with various beam deflection methods using electromagnets. Note that for the corners of phosphor coating 64, the horizontal beam 54 deflection is greater than the vertical beam 54 deflection. Accordingly, even though focus voltage and $i_{DQP}$ change, the spot shape tends to be distorted wider horizontally than vertically. If the minimum spot size requirement is ignored, however, a circular spot shape can be obtained with correct focus voltage and DQP current.

The focus voltage not only controls spot size and shape, but also affects the beam width (FIG. 2). FIG. 5 is a graph plotting beam width against focus voltage. As predicted by simulation and verified by measurement, in a conventional CRT, such as described in relation to FIGS. 3 and 4, the focus voltage required for the optimum "just in focus point" is not the same as the focus voltage required for minimum beam width. For example, for the curve shown, a minimum beam width occurs at the focus voltage $V_{MBW}$ for point A, but the just focus point occurs at the focus voltage $V_F$ for point B. (The other minimum beam width point indicated at the lower focus voltage is not considered because it produces an unacceptably large spot size.) The actual beam width changes as the focus voltage varies during normal operation. What is desired is to simultaneously optimize both the beam width incident on the phosphor elements that is required for picture uniformity and the spot size and shape required for good focus.

SUMMARY

In accordance with the invention, the electron beam in a CRT electron gun is shaped by passing through one or more apertures having an astigmatism. If one aperture is given the astigmatism, the aperture is given a 90 percent astigmatism. In one embodiment only the aperture in grid G5 is given the 90 percent astigmatism, and current in the DQP magnet is made sufficient such that minimum beam width occurs closer to the just focus point voltage. In another embodiment, astigmatisms in the apertures in both grids G1 and G5 combine to produce an effective 90 percent astigmatism. For example, apertures in grids G1 and G5 are each given a 0.95 astigmatism, thereby producing approximately a 90 percent total astigmatism (0.95*0.95=0.9025). In some embodiments in which astigmatisms in the apertures in both grids G1 and G5 produce the effective 90 percent astigmatism, DQP current is not used to further shape the electron beam. Combined G1 and G5 astigmatism embodiments without DQP correction offer a cost saving solution. In other embodiments in which the apertures in both grids G1 and G5 produce the effective 90 percent astigmatism, DQP current may be used to further shape the beam and produce a better result. Changing the aperture astigmatism, and further using proper current through the electromagnet, allows the focus voltage at which the just focus point occurs and the focus voltage at which minimum beam width occurs to be much closer together. Accordingly, the picture becomes more uniform over the entire viewing area, especially in the corners.

DETAILED DESCRIPTION

Figure 1:
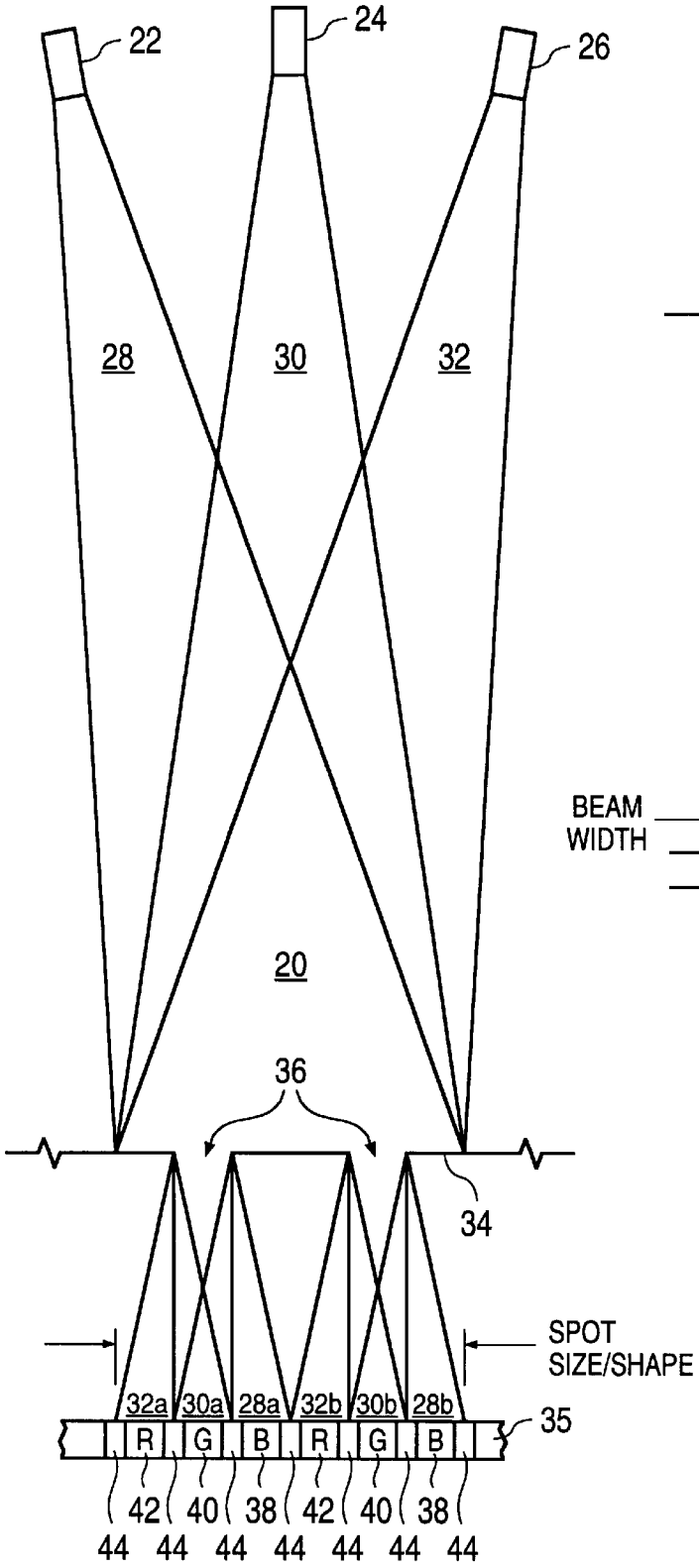
FIG. 1 is a simplified representational plan view showing a cross section of a typical CRT and electron beams directed to excite phosphor stripes
Figure 2:
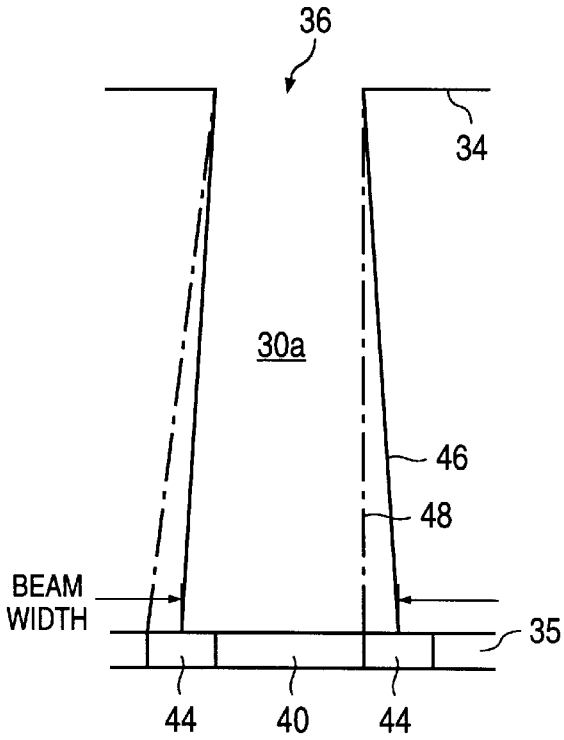
FIG. 2 is a simplified cross-sectional view of a portion of an electron beam passing though an aperture grill slit.

In order to more clearly illustrate and describe the invention, portions of the figures accompanying this description are not to scale, and many conventional components are omitted.

In accordance with the invention, electron beams generated by the CRT electron gun are directed through grid apertures with 90 percent astigmatism (height:width aspect ratio is approximately 90:100). In one embodiment, for example, the single aperture in grid G5 is given a 90 percent astigmatism. In another embodiment, the three apertures in grid G1 are each given a 90 percent astigmatism. In still other embodiments, the apertures in both grids G1 and G5 are given astigmatisms to produce an overall effective astigmatism in the electron gun of 90 percent. For example, the apertures in grids G1 and G5 may each be given a 95 percent astigmatism. The component electron beams (54*a–c*, FIG. 3) passing through these 95 percent astigmatism apertures receive an effect as if traveling through a single approximately 90 percent astigmatism aperture (0.95*0.95=90.25 percent astigmatism). Similarly, a 0.92 aperture astigmatism in G1 and a 0.98 aperture astigmatism in G5 also yields an approximately 90 percent (90.16) total astigmatism. Other variations are possible. Landing spot size also depends on beam current, and placing the astigmatisms in grids G1 and G5 improves this relationship.

The 90 percent astigmatism is selected over, for example, an 89 percent or a 91 percent astigmatism. Testing of various astigmatisms on either side of 90 percent has shown that using the 90 percent ratio produces the superior performance.

As discussed above, ideally, the "just in focus point" and minimum beam width occur at the same focus voltage. In accordance with the invention, for embodiments in which the 90 percent astigmatism is placed in the grid G5 aperture, the DQP current is used to further shape the electron beam to create a solution in which the "just in focus point" and minimum beam width occur much closer to this ideal. The DQP current is not presently used in production to shape the beam in embodiments in which astigmatisms in grid G1 and G5 apertures combine to produce a total effective 90 percent astigmatism because of processing costs required to properly shape the grid G1 apertures. However, current in the four-pole DQP electromagnet may be used to further shape the beam in all embodiments.

Figure 6A:
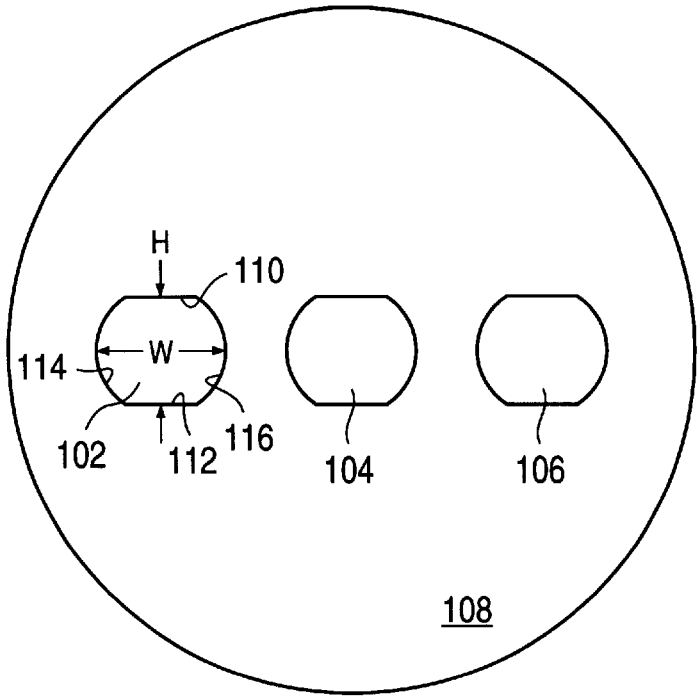
FIGS. 6A and 6B show embodiments of aperture astigmatisms.

FIG. 6A is a view showing three apertures 102, 104, and 106 defined in plate 108 in accordance with the invention. FIG. 6A is illustrative of aperture astigmatisms placed in grid G1. In use, for example, the electron beam exciting red phosphors is directed through aperture 102, the beam exciting green phosphors through aperture 104, and the beam exciting blue phosphors through aperture 106. As shown, each aperture 102, 104, and 106 is identically shaped. Aperture 102, for example, is circular but with top and bottom slightly truncated by parallel, equal length chord lines to form top edge 110 and bottom edge 112. Left edge 114 and right edge 116 are semicircular. Aperture edges are positioned so that the aspect ratio of height H, between top edge 110 and bottom edge 112, to width W, between left edge 114 and right edge 116, is approximately 90:100 (90 percent astigmatism).

Figure 6B:
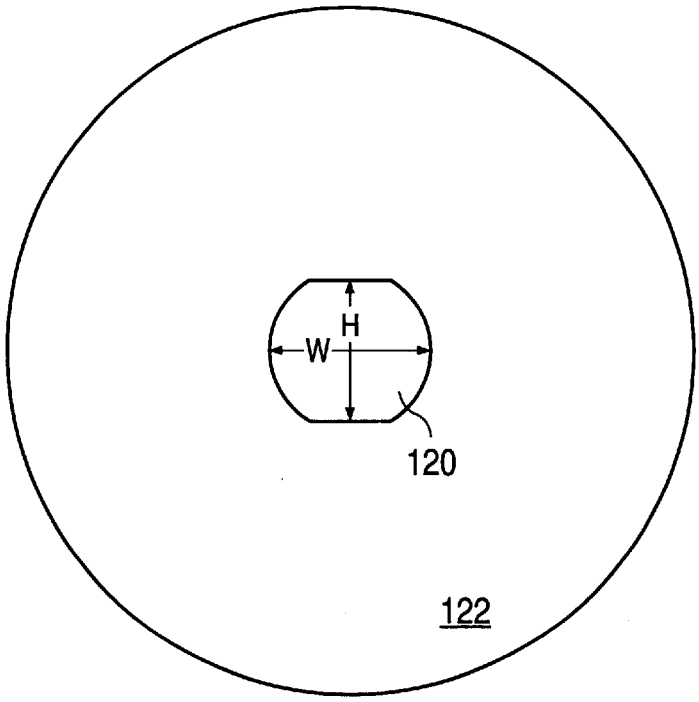

FIG. 6B is a view showing aperture 120 defined in plate 122 in accordance with the invention. FIG. 6B is illustrative of aperture astigmatisms placed in grid G5. In use, for example, composite electron beam 54 (FIG. 3) passes through aperture 120. The relation between height H and width W of aperture 120 is the same as for aperture 102, described above.

Apertures in plates 108 and 120 are formed using a conventional punching method. Plates 108 and 120 may be any material, e.g. metal, suitable for use in a CRT electron gun grid. Plates 108 and 120 are integral with grids G1 and G5, respectively, and each have a conventional electric potential during operation. Persons familiar with CRT design will understand grid electric potentials used in electron guns.

Figure 7:
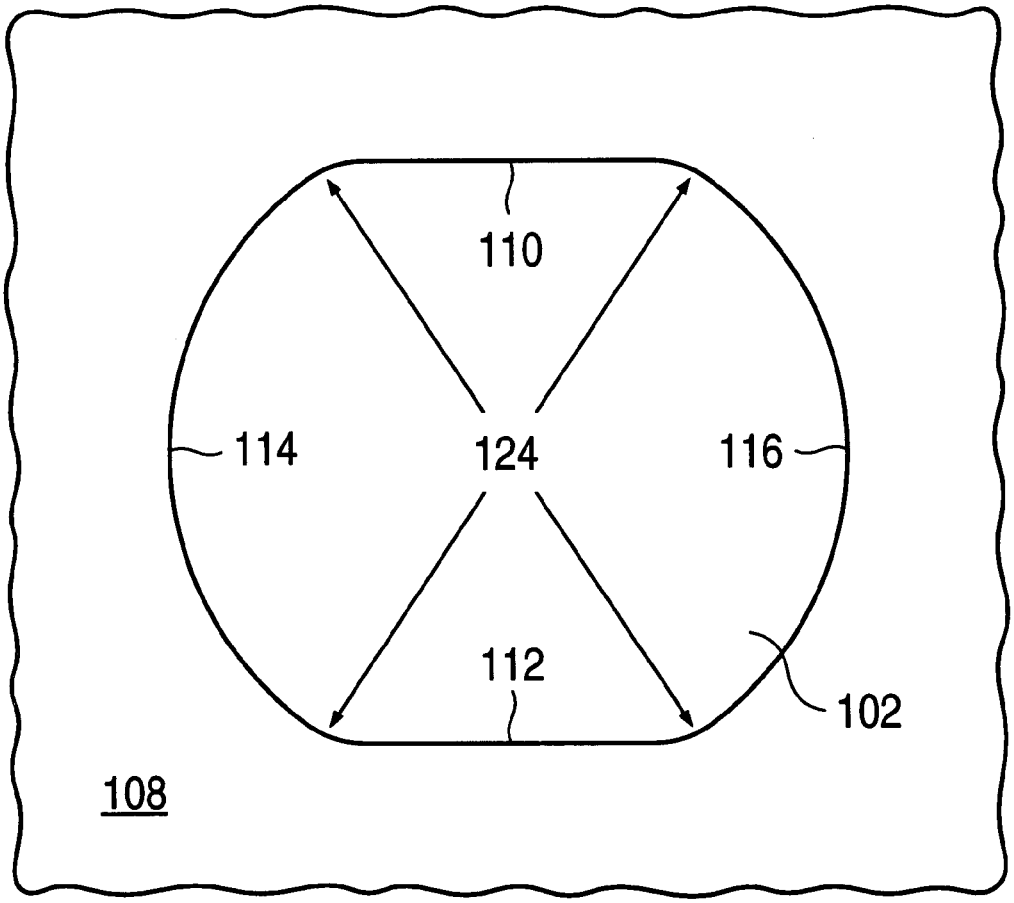
FIG. 7 is a view showing details of an embodiment of the invention.
Figure 8:
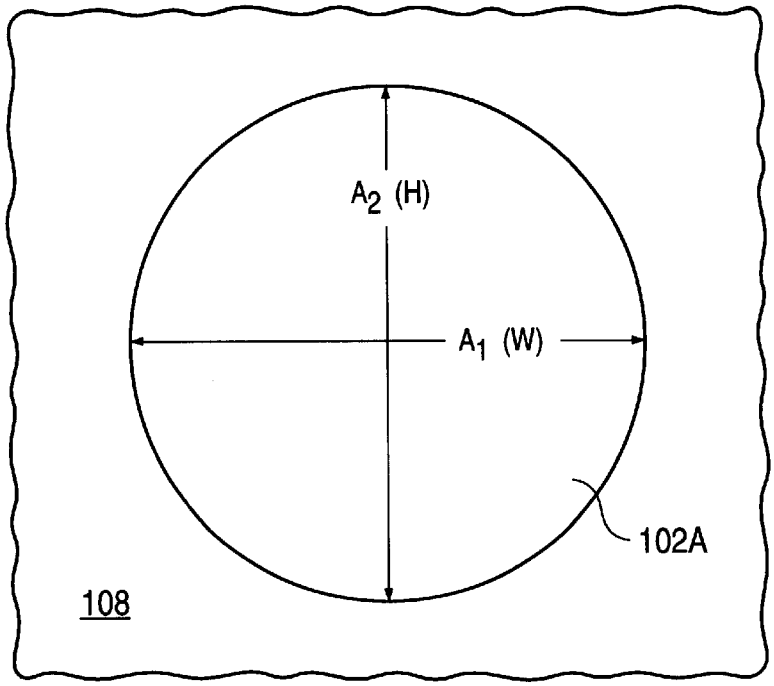
FIG. 8 is a view showing a second embodiment of the invention.
Figure 9:
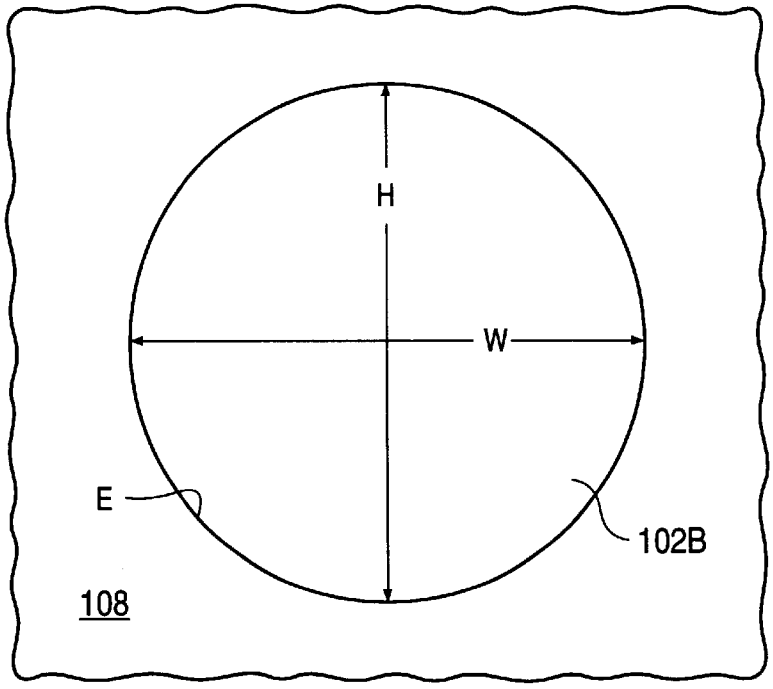
FIG. 9 is a view showing a third embodiment of the invention.

FIG. 7 is a view showing details of one embodiment of aperture 102. Details regarding aperture shape apply equally to apertures in grids G1 and G5. As shown, corners 124 are rounded so that the intersections of straight and curved edges are blended into one another. Rounding corners 124 reduces interference patterns that also distort spot size and shape incident on the aperture grill. In other embodiments apertures 102 or 120 may be shaped as an ellipse or other oval shape. FIG. 8 shows elliptical aperture 102A with the minor axis $A_2$ approximately 90 percent of the major axis $A_1$. FIG. 9 shows oval-shaped aperture 102B having height H approximately 90 percent of width W.

As discussed above, the electron beam spot size and shape is distorted in both the horizontal and vertical directions as the beam sweeps across the aperture grill. At the extreme corners, the horizontal beam displacement from center is larger than the vertical beam displacement from center. Therefore there is more horizontal distortion than vertical distortion at the corners of the viewing screen. Nevertheless, decreasing the vertical dimension of the apertures in, for example, grid G5 (FIG. 3) to approximately 90 percent of the horizontal dimension provides the necessary correction to the spot size horizontal distortion, when combined with new DQP current as discussed below.

Figure 3:
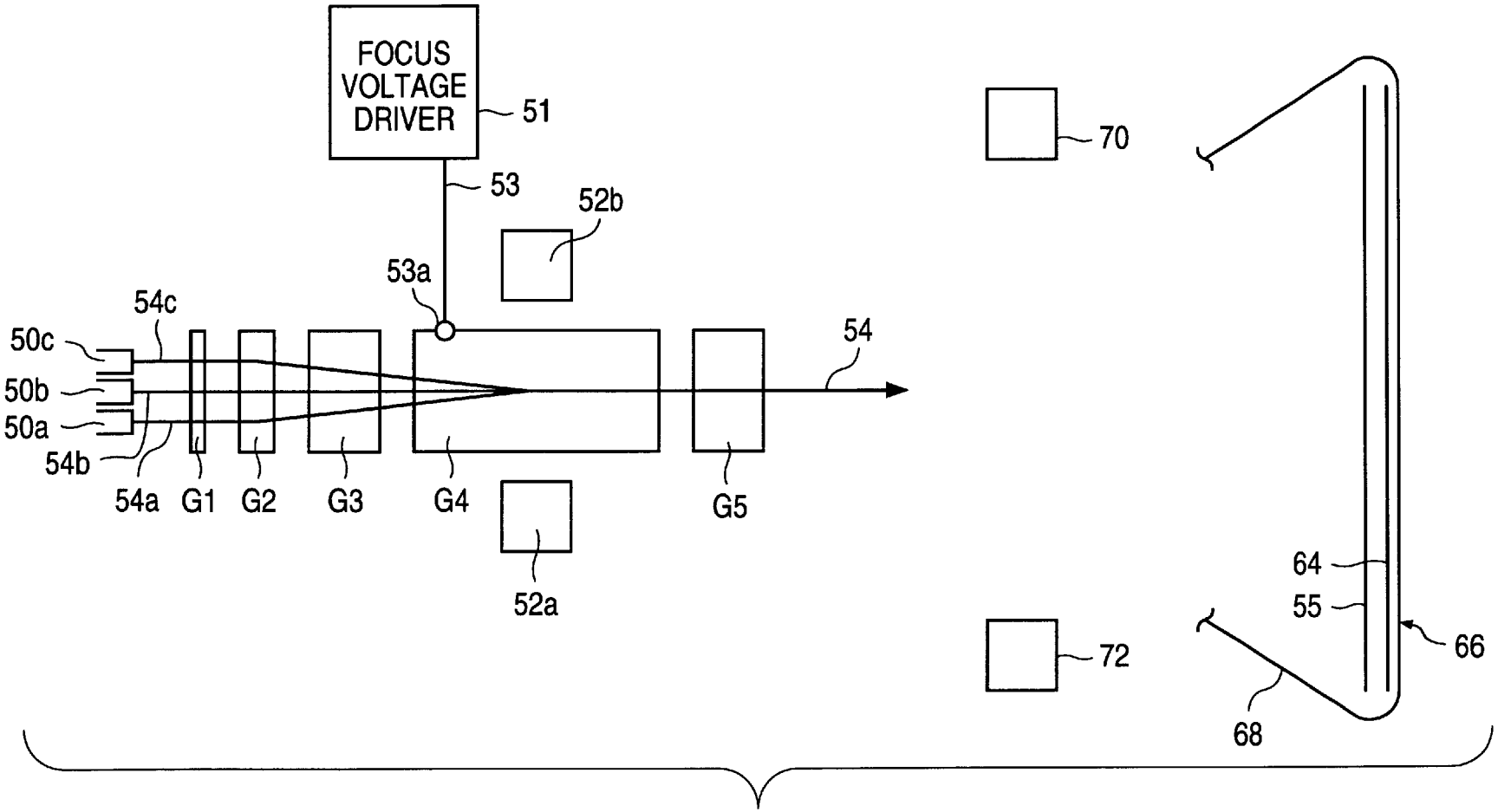
FIG. 3 is a representational view of selected components of a typical electron gun and CRT.
Figure 4:
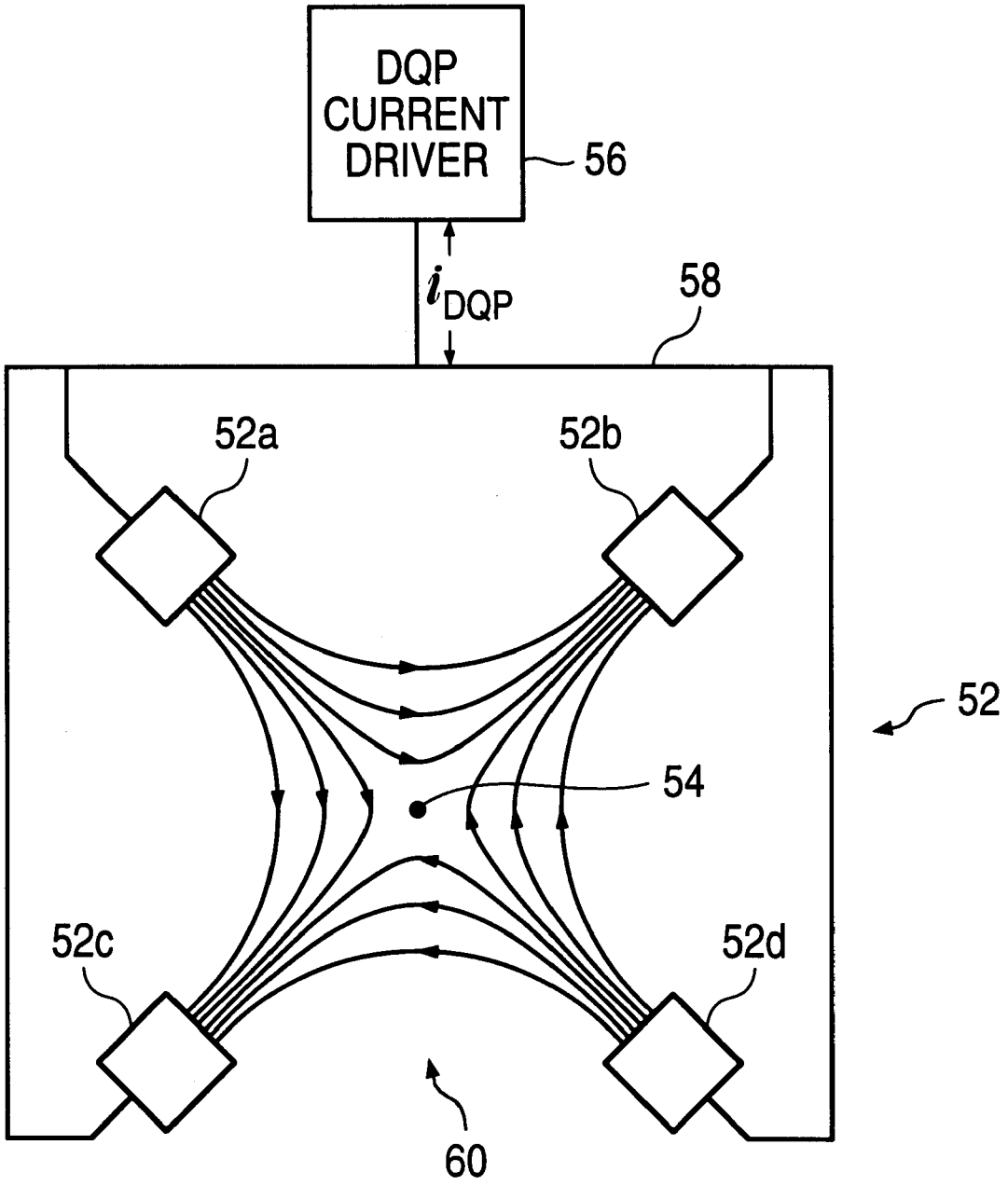
FIG. 4 is a representational side view of the electromagnets positioned around the electron gun focusing grid.

When the 90 percent astigmatism aperture is used in the grid G5 aperture, $i_{DQP}$ is adjusted to shape the electron beam and thereby produce proper landing spot size. To simultaneously correct all three beams, the DQP magnet is placed around the beams at a convergence point in grid G4 (FIG. 3). The actual $i_{DQP}$ continuously varies with beam position, and will also depend on variables such as viewing screen size and shape.

Figure 10:
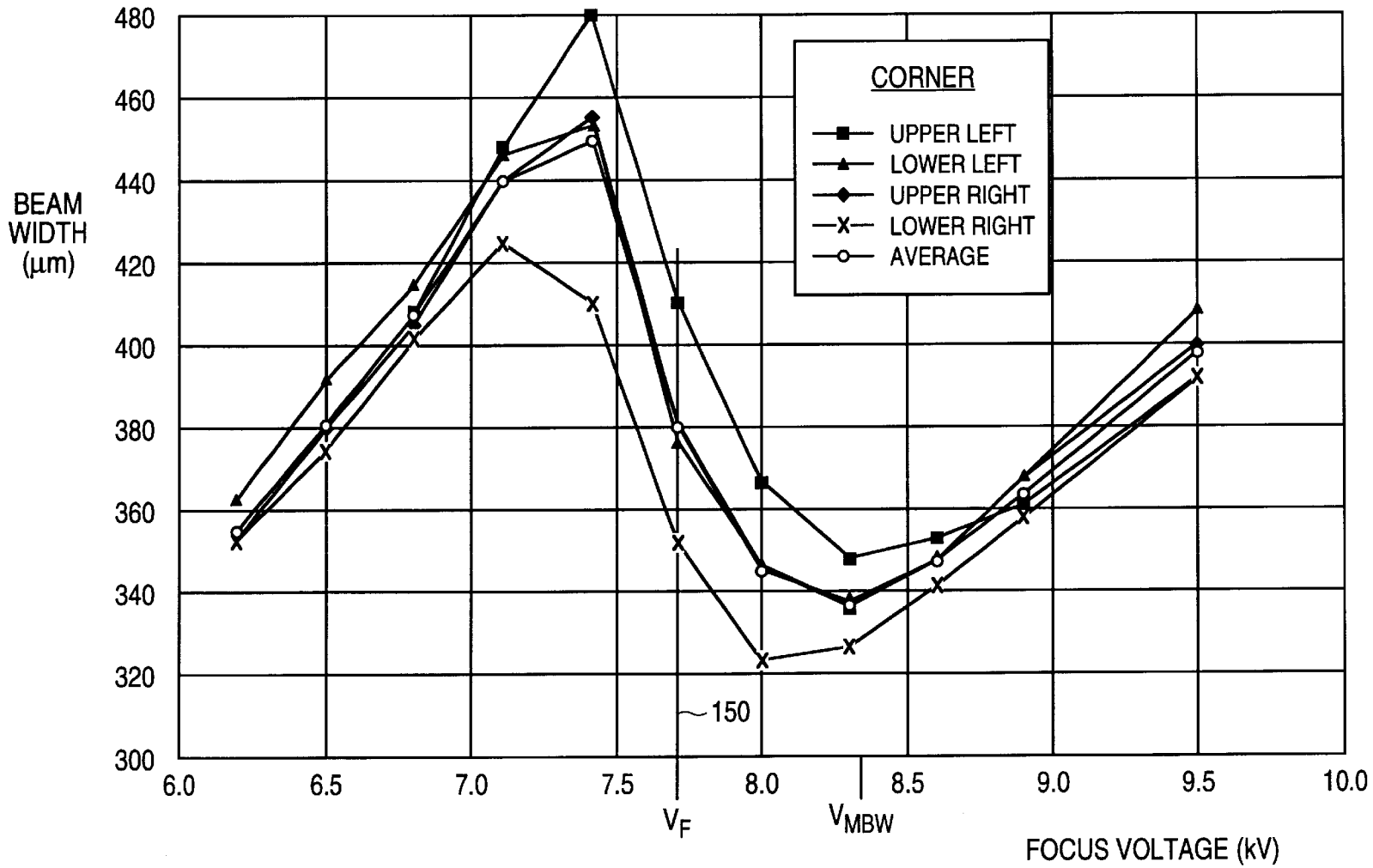
FIG. 10 is a graph plotting beam width against focus voltage using a conventional electron gun.
Figure 11:
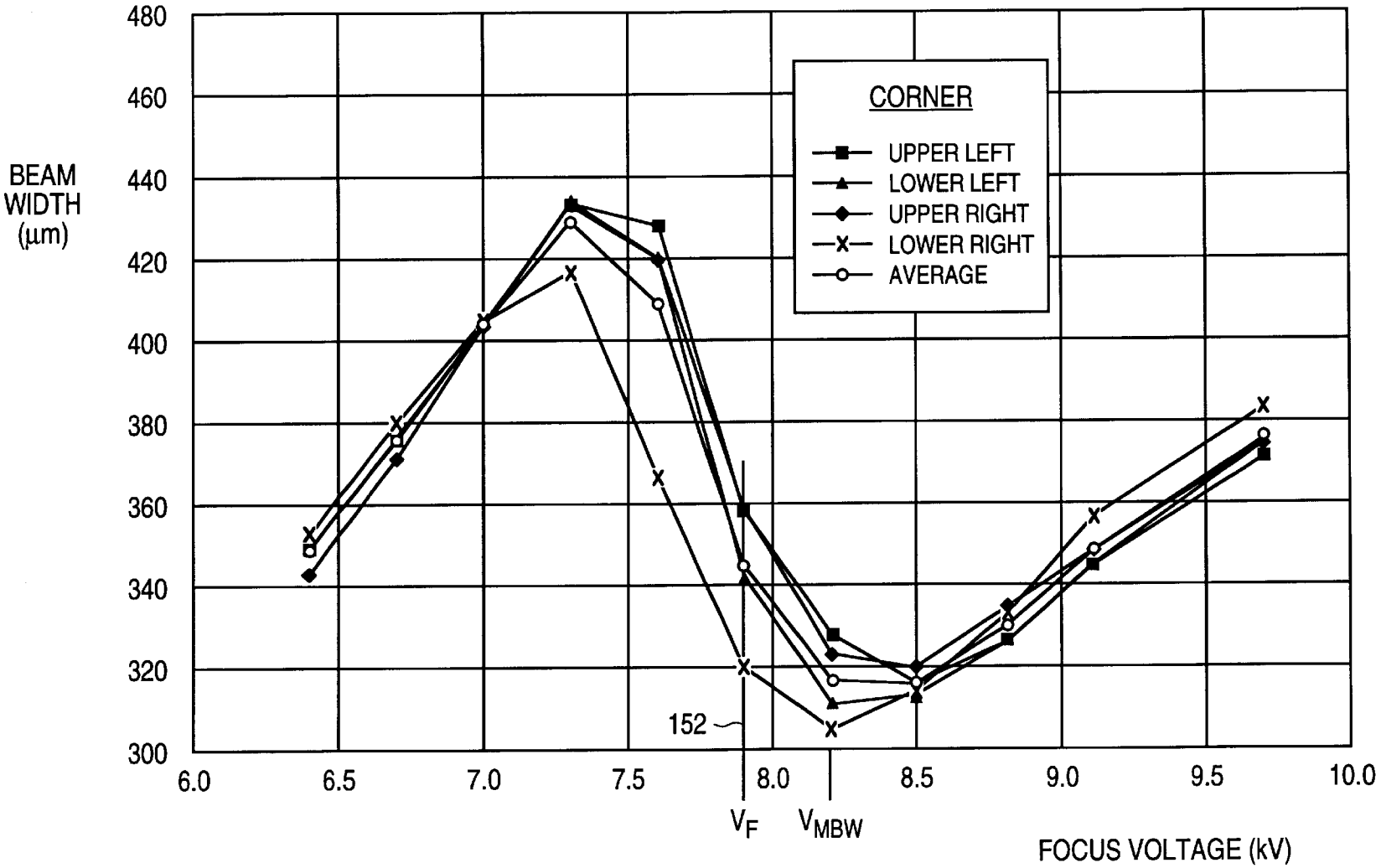
FIG. 11 is a graph plotting beam width against focus voltage using an embodiment of the invention.

FIGS. 10 and 11 are graphs plotting beam width versus focus voltage in the corners of the viewing screen. FIG. 10 shows results for a CRT having a gun with the prior 98 percent astigmatism apertures. FIG. 11 shows results for a CRT having a gun using the 90 percent astigmatism apertures in accordance with the invention. FIGS. 10 and 11 are based on measurements using a Yamato H-30 measuring instrument. For the results shown in FIGS. 10 and 11 the $i_{DQP}$ was held constant. It can be seen by comparing results shown that under static conditions the $V_F$ required for the just focus point is moved closer than before to the $V_{MBW}$ required for the minimum beam width when an electron gun having 90 percent astigmatism apertures is used.

FIG. 10 plots beam width versus focus voltage in the corners of a model 36RV CRT using a static $i_{DQP}$ of 350 mA. As shown, the average minimum beam width occurs at approximately 8.3 KV. The just focus point, indicated by vertical line 150, occurs at approximately 7.7 KV, a difference of approximately 0.6 KV. FIG. 11 plots beam width versus focus voltage in the corners of a model 36RV CRT using a static $i_{DQP}$ of 250 mA. As shown, the average minimum beam width occurs at approximately 8.2 KV. The just focus point, indicated by vertical line 152, occurs at approximately 7.9 KV, a difference of approximately 0.3 KV. The plots in FIGS. 10 and 11 are for fixed $i_{DQP}$. Under dynamic conditions, such as during typical operation of a consumer television receiver using the present invention, the focus voltage required for good spot size and good landing performance can be made more nearly identical.

A report of astigmatism evaluation results for 36RV has been prepared. The report summarizes the line width and other characteristics for G5 astigmatisms of 90 percent and 97 percent in 36RV.

Evaluation results for line width were reported. The conclusion was that combination with the DY (deflection magnetic field of the deflection yoke) of current 36RV makes the new 90 percent astigmatism more beneficial than the current 98 percent (97 percent) astigmatism in terms of corner line width and magenta.

There are variation factors for line (beam) width. The absolute value of corner line width varies with DY characteristics (34RV DY>36 RV DY) and the corner focus voltage varies with DY characteristics (34RV DY>36 RV DY). The corner line width is determined by the relation between the focus voltage and the line width vs. Ec4 (focus voltage) characteristic. Using 34 RS DY reduces the line width irrespective of the absolute value because the focus voltage is close to the minimum point of line width.

Table I shows information regarding difference in line width due to DY. Measurement conditions were: same CRT (98 percent astigmatism; 36RV) used; set 36HDF9, 34SF1; outside power source for IQP, focus. Evaluation method: Change in line width due to focus voltage at fixed IQP is measured at four corners, the just focus point is ascertained with a monoscope.

TABLE I

| | | 36RV DY Ec4 Line width | 34RS DY Ec4 Line width | 34RS DY X 0.945 Ec4 following high-voltage correction |
|---|---|---|---|---|
| Screen center | Focus, just point | 6.1 kV | 6.4 kV | 6.05 kV |
| IQP = −60 mA | Minimum point of line width | 6.1 kV 240 μm | 6.4 kV 240 μm | 6.05 kV |
| Screen corner | Focus, just point | 7.7 kV 380 μm | 8.6 kV 365 μm | 8.13 kV |
| IQP = 350 mA | Minimum point of line width | 8.3 kV 340 μm | 8.9 kV 360 μm | 8.41 kV |
| Difference between | Focus, just point | 1.6 kV | | 2.08 kV |
| screen center, corner | Minimum point of line width | 2.2 kV | | 2.36 kV |

Measured high voltages during ABL: KW-36HDF9: 28.09 kV, 28.09/29.71=0.945; KV-34SF1: 29.71 kV. The IQP value used here (350 mA) was obtained under the conditions maintained during trial productions, whereas the IQP for an existing set was about 300 mA, so, overall, the line width was reduced by 30 μm or greater. In summary, in the same CRT, the minimum line width in the corner is greater for a 34RS DY. The line width at the corner focus just point is greater for a 34RS DY. Reversal of these two qualities is attributed to the fact that the corner focus voltage of a 34RS DY is higher by about 300 V than that of a 36RV DY. The increase (on the under side) in the corner focus voltage of a 34RS DY is attributed to the strong concave lines component of the 34RS CFD (convergence free deflection yoke; three beams converge on the screen without any correction circuit) in the H direction. Because the line width is basically determined by the width (in the H direction) of the beam impinging on DY, the minimum point of line width affords the same focus voltage irrespective of DY, provided the IQP is the same. Because the H size in a deviated magnetic field increases with an increase in the concave lens component of CFD (even when the incident beam width is the same), the minimum line width increases, and the minimum point of line width shifts in the direction of underfocus. The reversal mentioned above causes the corner spot of 34 RS to undergo vertical collapse (an increase in H size) and tends to make it easier for magenta to develop.

There are variations in line width due to focus voltage. The V-shape characteristic of line width vs. Ec4, which has been measured in the past and which is aimed at minimizing the line width near the just focus point, was simulated based on three assumptions (H size of electron beam in the center of deviation, angle of incidence on the fluorescent screen, and beam superposition of raster deviation) was simulated and described. It was also predicted in the course of the simulation that the minimum point of the V-shape would be one of the minimum values and that W-shape characteristics would be obtained within a wide range of line width vs. Ec4 characteristics. The simulation was proven to be correct by confirming the W-shape through measurements. Changing the IQP toward the minus side causes an increased line width to form a gentler slope in the direction from the minimum line width of the V-shape to the overfocus side (low Ec4), irrespective of G5 astigmatism. This is attributed to reduced components for angles at which the electron beam impinges on the fluorescent screen.

Figure 5:
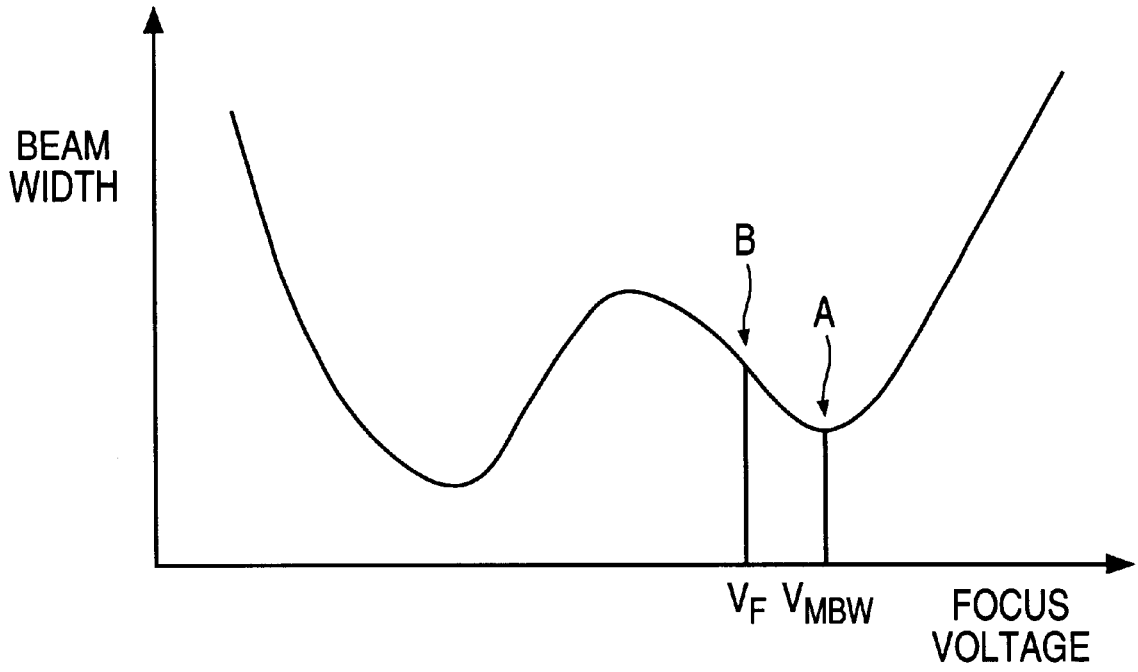
FIG. 5 is a graph plotting beam width against focus voltage.

Line width varies with focus voltage as shown in FIG. 5. The "W-shape" of the change was predicted by a line width simulation and confirmed by subsequent measurements. The magnitude of line width under actual service conditions varies with the shift of the just focus point and with an increase in line width from the minimum point of line width in the direction of lower focus voltages (over side). Assumptions made for line width simulations: beam size in the H direction in the center of deviation; angle at which each beam impinges on the fluorescent screen (AG slit); beam superposition due to raster deviation.

Factors causing W-shape line width to vary include the following. Reduction in line width from underfocus (high Ec4): Line width decreases due to reductions in the size of the beam impinging at the center of deviation and in the angle of incidence of the beam. Increase in line width from just focus to overfocus (low Ec4) to just focus: Although the beam impinging at the center of deviation subsequently decreases in size, the angle of incidence of peripheral beams markedly increases, and the line width reaches its maximum value as a result of the combined effect of the two factors. Minimum value on the overfocus side: Although the beam impinging at the center of deviation subsequently decreases in size, the angle of incidence of peripheral beams markedly increases, and the line width reaches its minimum value as a result of the combined effect of the two factors. Increase in line width farther on the overfocus side: Although the beam impinging at the center of deviation subsequently decreases in size, the angle of incidence of other beams (including peripheral) markedly increases, and the line width increases as well. The following phenomenon is observed in the case of further overfocusing: the just focus point of the beam (minimum point of beam size) rapidly retracts from the fluorescent screen toward the electron gun, just focus is achieved at a value about 1.5 kV lower than the just focus voltage on the fluorescent screen, and the size of the beam impinging at the center of deviation reaches its minimum value.

Figure 12:
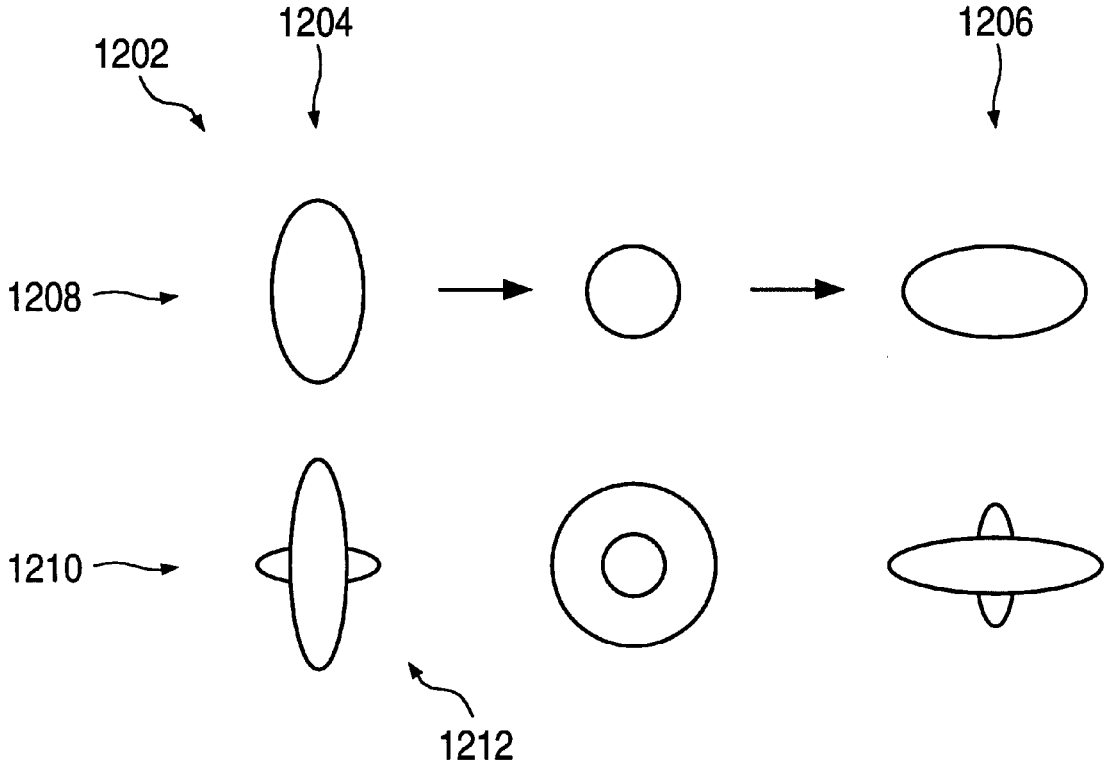
FIG. 12 is a plot showing spot shape in center screen and lens action in the H direction.

There are effects of IQP and G5 astigmatism on line width. Changing the IQP toward the minus side at the screen center causes the increased line width to form a gentler slope in the direction from the minimum value of line width to the overfocus (low Ec4). This change in slope is irrespective of the G5 astigmatism. FIG. 12 shows the shape of center spot on the screen; lens action in H direction of NA. The plot 1202 shows lens action in H direction. Leftmost column 1204 shows IQP minus high and concave lens weak. Rightmost column 1206 shows IQP minus low and concave lens strong. Upper row 1208 shows just focus. Lower row 1210 shows overfocus. As shown, the lens in the H direction of G5 is constant irrespective of astigmatism. The spot shape at NA varies with the magnitude of IQP. The shape shown at 1212 illustrates a beam with a large angle of incidence on the overfocus side forms an H halo, and this increases the line width.

There is a relation among line width, uniformity, and sense of focus. 36RV CRTs with G5 astigmatisms of 98 percent and 90 percent were used in the overall evaluation of DY for 36RV and DY for 34 RS. The combination of 90 percent astigmatism and DY for 36 RV affords the widest range for both the magenta and the sense of focus. In addition, the line width in this state is lower by at least 13 μm the value for the 98 percent astigmatism. When DY for 34 RS was used, the magenta was too strong, and no usable range was found.

Advantages and disadvantages if introducing a G5 astigmatism of 90 percent were reported. Regarding misrun allowance, in TVJ setting other improvement measures were introduced, producing an overall improvement of about 20 μm in comparison with the −18 μm at the start of O/L. (The improvement is 6 μm when 90 percent astigmatism alone is used.) The misrun allowance was plus 1 μm. In TVA setting a misrun allowance on the order of 32RV could be achieved by introducing 90 percent astigmatism and other improvements. Regarding focus, the center focus deteriorated by a rank of 0.1 as a result of a switch to 90 percent astigmatism (with HD model). Regarding CRT manufacture, switchover loss due to model number increases, and other problems remain. Regarding set side, waveform modifications of DQP was needed. In manufacture, spot rotation adjustment emphasizing corner line width should be changed to center adjustment (ease of adjustment). Sorting by L/D destination should be abolished. Tube refurbishing measures.

Conclusion was that all 36RVs should be switched to G5 90 percent astigmatism (DTV (TVA), DJ (JP), HJ (JP), BJ (JP)).

TABLE II shows G5 astigmatism and corner line width.

TABLE II

| | 98% astigmatism | | 90% astigmatism |
|---|---|---|---|
| | 36RVDY | 34RSDY | 36RVDY |
| IQP | 350 mA | 350 mA | 250 mA |
| Line width minimum | 340 μm, 8.3 kV | 360 μm, 8.9 kV (8.41) | 315 μm, 8.3 kV |
| Line width at just focus, Ec4 | 380 μm, 7.7 kV | 365 μm, 8.6 kV (8.13) | 345 μm, 7.9 kV |
| Maximum line width | 450 μm | 475 μm | 430 μm |
| (Maximum) - (minimum) | 110 μm | 115 μm | 115 μm |
| (Minimum) - (just) | 600 V | 300 V (280) | 400 V |
| Magenta | Narrow margin at high Ec4 values | Extremely poor | Good |

The IQP value used here (350 mA) for 98 percent was obtained under the conditions maintained during trial production, whereas the IQP for an existing set is about 300 mA, so, overall, the line width was reduced by 30 μm or greater.

The following statements are true for a combination of 36RVDY and a G5 astigmatism of 90 percent. The minimum value of the corner line width decreases at 90 percent astigmatism. This is because of low IQP. The convex lens in the H direction of NA (neck assembly; DQP coils are on this assembly) due to IQ is weak in comparison with 98 percent astigmatism. Thus, although he H size of the beam at the center of deviations is considerable, the angle of incidence is small, as is the line width. The focus voltage of minimum line width is that same as at 98 percent. At 98 percent, a beam incident at the center of deviation is smaller in terms of H size, but its angle of incidence is considerable. Thus the shift is towards higher minimum points of line widths at 98 percent. The focus just point is shifted toward higher Ec4. In comparison with 98 percent, the H size increases in proportion to the reduction in the magnitude of IQP. Thus as in the case of 34 RS DY, the shift is toward higher just foci. This is close to the minimum point of line width. Finally, magenta is difficult to develop. The H size increases, but the result is different from that for the DY deviation distortion of 34RS. Thus the size is considerable in the V direction due to the concave lens action of G5 astigmatism (halo is difficult to develop). Thus magenta is difficult to develop.

TABLE III shows line width for the just sense of focus. The evaluation involved determining the line width, sense of focus, and magenta for a case in which the IQP was adjusted to obtain a just focus at each voltage while the focus voltage was varied in steps of 0.3 kV. Ec4, IQP ranges in which both magenta and sense of focus were achieved. The magenta margin was wider for 90 percent astigmatism.

TABLE III

| 36RV, range of possible | | 98% | 90% |
|---|---|---|---|
| Screen center | Ec4 | 6.1 kV | 6.1 kV |
| | IQP | −70 mA | −220 mA |
| | Line width | 228 μm | 227 μm |
| Corner | Ec4 | 7.4–(7.7) | 7.6–7.9 |
| | IQP | 280–(320) | 200–250 |
| | Line width: Mean | 375–(353) | 355–340 |
| | Upper left | 390–(375) | 360–345 |

TABLE III-continued

| 36RV, range of possible | | 98% | 90% |
|---|---|---|---|
| | Lower left | 375–(355) | 355–330 |
| | Upper right | 395–(365) | 370–355 |
| | Lower right | 340–(320) | 345–330 |
| Inside effective screen surface | DOP | 350–(390) | 420–470 |
| Peak to Peak | DF | 1.3–1.6 | 1.5–1.8 |

Technical conclusions concerning 36RV line width and G5 astigmatism are in the current 36RV DY and DQP/DF systems, 90 percent astigmatism is more advantageous for the line width and magenta. Since 34 RS and 38RS differ in terms of DY, the results are not necessarily the same as for 36RV. The distortion of spot deviation due to DY is corrected differently for DQP, DF, and G5 astigmatism, and the line width and sense of focus vary depending on the combination. This is because of the differences in the beam width as measured in the H direction at the center of deviation (which determines the line width), and in the sensitivity of different correction means in relation to the beam angle.

The present invention has been described in terms of specific embodiments. However, persons skilled in CRT design will understand that many variations of the present invention are possible. Therefore the invention is limited only be the scope of the following claims.

I claim:

1. An apparatus for correcting electron beam landing geometry in a cathode ray tube, the apparatus comprising:

a source of electrons producing an electron beam;

a plurality of grids, wherein each grid in the plurality of grids has a unique aperture and each grid in the plurality of grids is positioned such that the electron beam passes through each unique aperture, and wherein each unique aperture has an astigmatism such that the product of the astigmatisms of each unique aperture is substantially equivalent to a 90 percent astigmatism in a single aperture.

2. The apparatus of claim 1 further comprising:

an electromagnet positioned around the electron beam; and a current driver coupled to the electromagnet, the driver supplying a sufficient current to the electromagnet to shape the landing geometry of the beam on a phosphor screen.

3. The apparatus of claim 2 further comprising a focusing grid positioned such that the electron beam passes through the focusing grid, and wherein the electromagnet is positioned around the focusing grid.

4. The apparatus of claim 1 wherein at least one aperture in the plurality of grids is shaped as an interior portion of a circle intersected by two substantially parallel and equal length chord lines.

5. A method of correcting electron beam landing geometry in a cathode ray tube, the method comprising the acts of:

providing a source of electrons for producing an electron beam;

providing a plurality of grids, wherein each grid in the plurality of grids has a unique aperture and each grid in the plurality of grids is positioned such that the electron beam passes through each unique aperture, and wherein each unique aperture has an astigmatism such that the product of the astigmatisms of each unique aperture is substantially equivalent to a 90 percent astigmatism in a single aperture.

6. The method of claim 5 further comprising the acts of:

providing an electromagnet positioned around the electron beam;

providing a current to the electromagnet; and adjusting the current to cause both a just focus point of the beam and a minimum width of a portion of the beam incident on a phosphor viewing screen to occur at approximately a same focus voltage.

7. The method of claim 6 further comprising the acts of:

providing a focusing grid positioned such that the electron beam passes through the focusing grid; and positioning the electromagnet around the focusing grid.

8. The apparatus of claim 1 further comprising:

a four pole magnetic field positioned around the electron beam; and a current driver driving the magnetic field to shape the landing geometry of the beam on a phosphor screen.

9. The apparatus of claim 8 further comprising a focusing grid positioned such that the electron beam passes through the focusing grid, and wherein the magnetic field is positioned around the focusing grid.

10. The method of claim 5 further comprising the acts of:

providing a magnetic field around the electron beam; and adjusting the magnetic field to cause both a just focus point of the beam and a minimum width of a portion of the beam incident on a phosphor viewing screen to occur at approximately a same focus voltage.

11. The method of claim 10 further comprising the acts of:

providing a focusing grid positioned such that the electron beam passes through the focusing grid; and positioning the magnetic field around the focusing grid.

* * * * *